US007431528B2

(12) United States Patent
Liu

(10) Patent No.: US 7,431,528 B2
(45) Date of Patent: Oct. 7, 2008

(54) TELESCOPIC HANDWRITING PEN

(76) Inventor: Ya-Chiao Liu, No. 6, Lane 286, Tatung Rd., Sec. 1, Shichi, Taipei Hsien (TW) 22145

( * ) Notice: Subject to any disclaimer, the term of this patent is extended or adjusted under 35 U.S.C. 154(b) by 639 days.

(21) Appl. No.: 11/159,298

(22) Filed: Jun. 23, 2005

(65) Prior Publication Data

US 2007/0020037 A1 Jan. 25, 2007

(51) Int. Cl.
*B43K 1/10* (2006.01)
*B43K 7/12* (2006.01)
*G09G 5/00* (2006.01)

(52) U.S. Cl. ..... 401/258; 401/117; 401/99; 345/179; 16/427; 16/429

(58) Field of Classification Search ..... 401/99, 401/117, 195, 131, 258, 259, 260, 251; 345/179; 16/427, 429

See application file for complete search history.

(56) References Cited

U.S. PATENT DOCUMENTS 4,601,599 A * 7/1986 Katoh ..... 401/99
6,474,889 B2 * 11/2002 Kato ..... 401/117
6,616,365 B1 * 9/2003 Vann ..... 401/117
7,001,093 B2 * 2/2006 Rosso ..... 401/131

* cited by examiner

*Primary Examiner*—David J Walczak
(74) *Attorney, Agent, or Firm*—Bacon & Thomas, PLLC

(57) ABSTRACT

A telescopic handwriting pen for PDA or cellular phone. In one embodiment, the pen comprises tubelike inner, intermediate, and outer sections and first and second coupling assemblies fitted in front ends of the inner and intermediate sections. Either coupling assembly includes annular grooves with O-rings put thereon, an annular recess between the grooves filled with lubricating oil, and a rear extension secured to the inner or intermediate section. A writing head is fitted in a front end of the outer section and comprises a channel in fluid communication with the external and inside of the second coupling assembly. Stop mechanisms are provided in rear ends of the outer and intermediate sections for preventing an inside section from disengaging another section while sliding therein. The pen can carry out a smooth sliding and has a balanced weight.

7 Claims, 6 Drawing Sheets

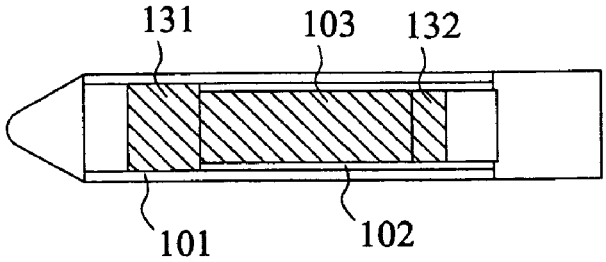
Fig. 6(a)
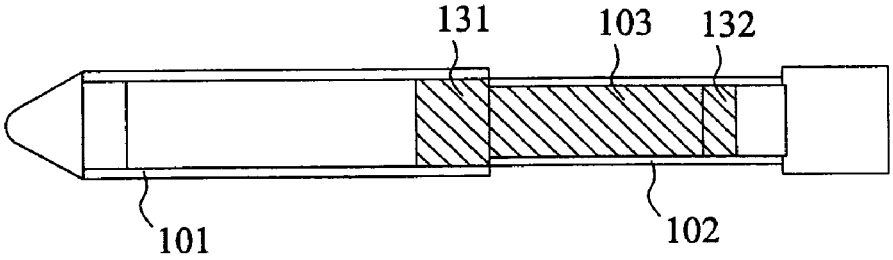
Fig. 6(b)
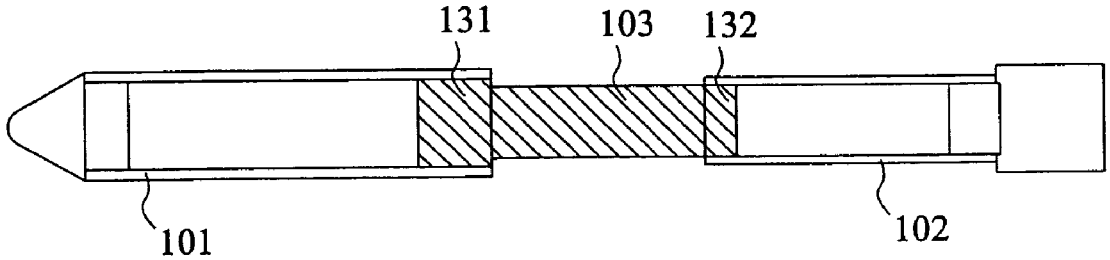
Fig. 6(c)
Fig. 6
PRIOR ART

TELESCOPIC HANDWRITING PEN

BACKGROUND OF THE INVENTION

1. Field of Invention

The present invention relates to telescopic handwriting pens for PDAs (personal digital assistants) or cellular phones and more particularly to such a telescopic handwriting pen with improved characteristics.

2. Related Art

A conventional telescopic handwriting pen is shown in FIG. 5 and comprises first, second, and third sections 90, 91, and 92 in the form of sleeve. The first section 90 comprises a separate forward writing head 900 and has a rear end connected to a front end of the second section 91. A rear end of the second section 91 is connected to a front end of the third section 92. A rear end of the third section 92 is fitted with a cap 93. In use, pull the cap 93, the second section 91, and the third section 92 sequentially to form a pen. Two pairs of opposite, thin metal members 94 of arcuate section are provided between the first section 90 and the second section 91 and between the second section 91 and the third section 92 respectively. The section of each metal member 94 has an arc length less than half of periphery of the section 91 or 92 therebetween. The metal member 94 comprises a tab 95 on an inner surface. Correspondingly, two opposite holes 96 are formed on the front end of each of the second section 91 and the third section 92. The tabs 95 are snugly fitted in the holes 96 for fastening the metal members 94. Further, the metal members 94 provide a frictional contact either between the first and the second sections 90 and 91 or between the second and the third sections 91 and 92. As a result, the first, second, and third sections 90, 91, and 92 are prevented from disengaging the pen while outward sliding.

But this is unsatisfactory for the purpose for which the invention is concerned for the following reasons: First, loud sounds are produced in sliding operation of the pen sections due to contact with the metal members 94. Second, the sliding operation is not smooth due to no lubricating oil in the components of the pen. Third, the assembly is relatively difficult and time consuming. Particularly, fitting the tabs 95 in the holes 96 requires high precision with high manufacturing cost. Thus, it is not desirable in view of the competitive market.

Another conventional telescopic handwriting pen is shown in FIG. 6 and comprises an outer section 101 in the form of sleeve, an intermediate section 102 in the form of sleeve, and a solid, cylindrical inner section 103. The inner section 103 comprises at its front end an enlarged first coupling member 131 adapted to slide within the outer section 101, and at its rear end a second coupling member 132 adapted to slide within the intermediate section 102. In a fully extended state of the pen, the first coupling member 131 is blocked in the rear end of the outer section 101 and the second coupling member 132 is blocked in a front end of the intermediate section 102. To the contrary in a fully retracted state of the pen, the inner section 103 slides inside the intermediate section 102 and the intermediate section 102 slides inside the outer section 101 respectively.

But this is still unsatisfactory for the purpose for which the invention is concerned for the following reasons: First, the sliding operation is not smooth due to the solid inner section 103. Second, weight of the extended pen is not balanced because the inner section 103 is solid. As a result, inconvenience can be caused in a handwriting operation. Thus, the need for improvement still exists.

SUMMARY OF THE INVENTION

It is therefore an object of the present invention to provide a telescopic handwriting pen having advantages of being smooth in its sliding operation and balanced weight.

In one aspect of the present invention there is provided a telescopic handwriting pen comprising a tubelike inner section including at its both ends front and rear inner threads; a first coupling assembly including a rod-shaped member having first and second annular grooves two first O-rings put on the first and the second grooves, an annular recess between the first and the second grooves filled with lubricating oil, and an outer threaded extension projected from its rear end threadedly secured to the front inner threads of the inner section; a tubelike intermediate section including an inwardly extending rim at its rear end; a hollow cylindrical second coupling assembly including a rod-shaped member having third and fourth annular grooves two second O-rings put on the third and the fourth grooves, an annular recess between the third and the fourth grooves filled with lubricating oil, and an outer extension projected from its rear and lockingly fitted in a front end of the intermediate section; a cap including an outer threaded extension projected from its front end and threadedly secured to the rear inner threads of the inner section; a tubelike outer section including an inwardly extending rim at its rear end; and a writing head lockingly fitted in a front end of the outer section, whereby sliding the inner section rearward by holding the cap until a shoulder between the rear groove of the first coupling assembly and the threaded extension of the first coupling assembly is stopped by the inwardly extending rim of the intermediate section, and further sliding the inner section rearward until a shoulder between the rear groove of the second coupling assembly and the outer extension of the second coupling assembly is stopped by the inwardly extending rim of the outer section will fully extend the handwriting pen.

In another aspect of the present invention there is provided a telescopic handwriting pen comprising a tubelike inner section including at its both ends front and rear inner threads; a first coupling assembly including a rod-shaped member having first and second annular grooves two first O-rings put on the first and the second grooves, an annular recess between the first and the second grooves filled with lubricating oil, and an outer threaded extension projected from its rear end threadedly secured to the front inner threads of the inner section; a cap including an outer threaded extension projected from its front end and threadedly secured to the rear inner threads of the inner section; a tubelike outer section including an inwardly extending rim at its rear end; and a writing head lockingly fitted in a front end of the outer section, whereby sliding the inner section rearward by holding the cap until a shoulder between the rear groove of the first coupling assembly and the threaded extension of the first coupling assembly is stopped by the inwardly extending rim will fully extend the handwriting pen.

In yet another aspect of the present invention the writing head comprises a channel in fluid communication with the external and inside of the handwriting pen.

The above and other objects, features and advantages of the present invention will become apparent from the following detailed description taken with the accompanying drawings.

BRIEF DESCRIPTION OF THE DRAWINGS

FIG. 6 is a sectional view of showing relative positioning of the components of another conventional telescopic handwriting pen in three phases (a), (b) and (c) of its extending operation.

DETAILED DESCRIPTION OF THE INVENTION

Figure 1:
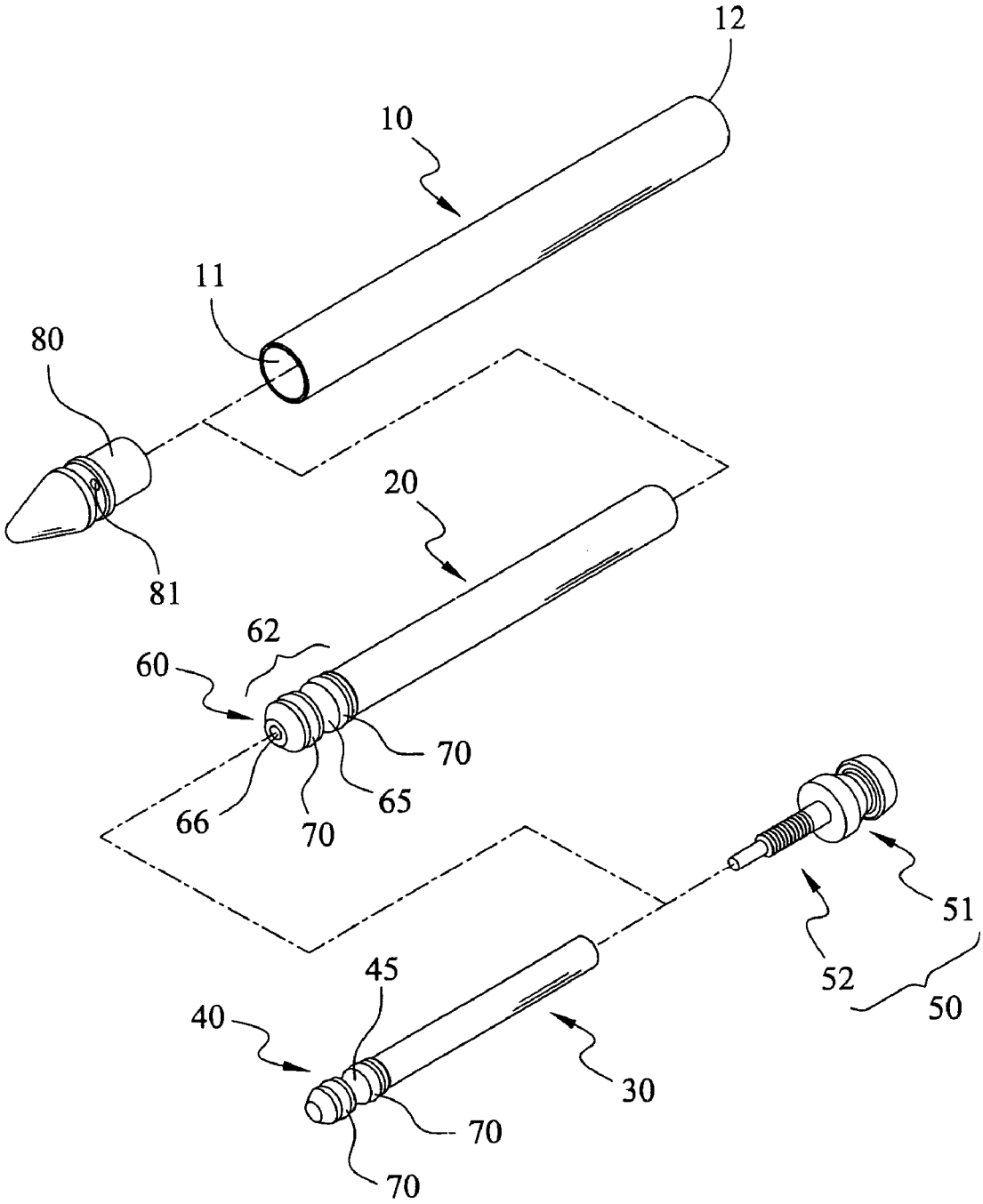
FIG. 1 is an exploded view of a preferred embodiment of telescopic handwriting pen according to the invention.
Figure 2:
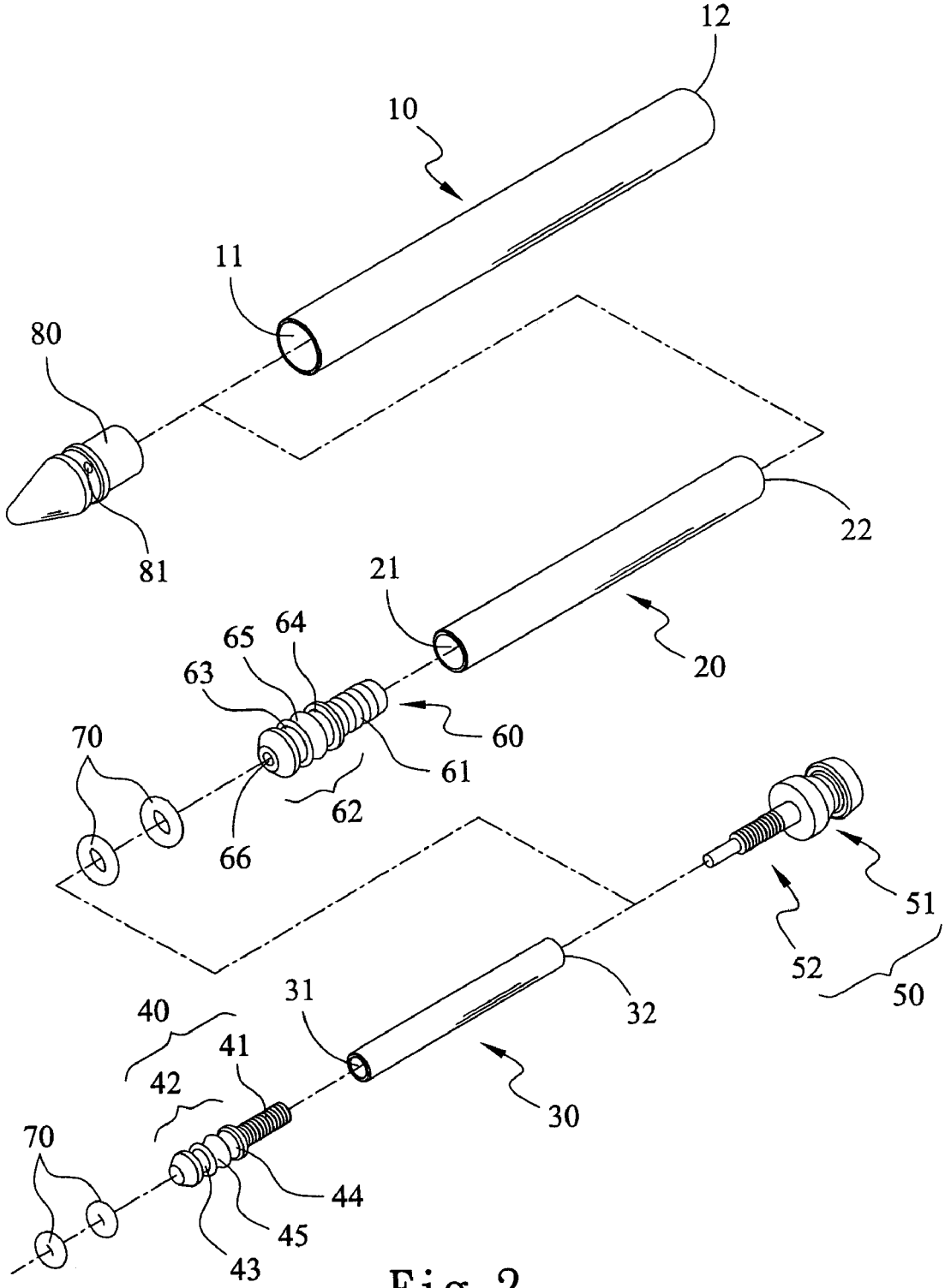
FIG. 2 is another exploded view of the telescopic handwriting pen in great detail.
Figure 3:
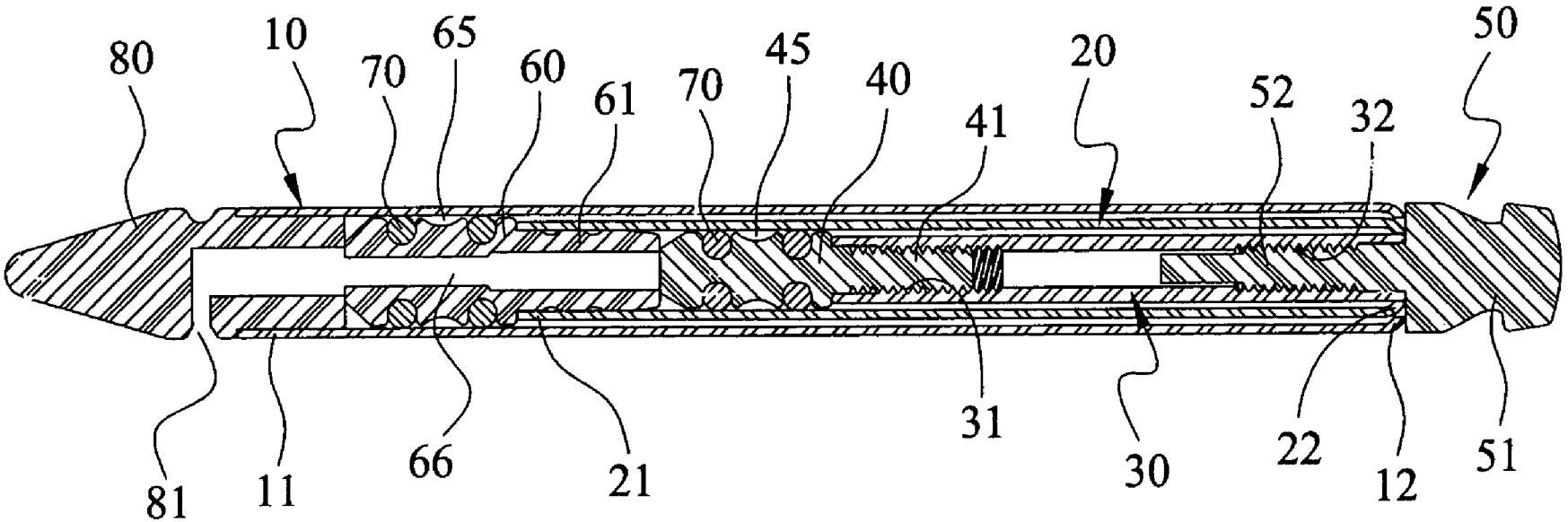
FIG. 3 is a sectional view of the assembled handwriting pen in its retracted state.

Referring to FIGS. 1, 2 and 3, a telescopic handwriting pen constructed in accordance with a preferred embodiment of the invention comprises an outer section 10, an intermediate section 20, and an inner section 30 all in the form of sleeve. The inner section 30 comprises at its both ends inner threads 31 and 32. A rod-shaped first coupling assembly 40 is fitted in a front end of the inner section 30 and comprises a member 42 having two annular grooves 43 and 44 and an annular recess 45 between the grooves 43 and 44, and an outer threaded extension 41 projected from its rear threadedly secured to the inner threads 31. Two O-rings 70 are put on the grooves 43 and 44. A hollow cylindrical second coupling assembly 60 is fitted in a front end 21 of the intermediate section 20 and comprises a member 62 having two annular grooves 63 and 64 and an annular recess 65 between the grooves 63 and 64, an outer extension 61 of toothed lengthwise section projected from its rear and tightly fitted in the front end 21 of the intermediate section 20, and a central bore 66. Another two O-rings 70 are put on the grooves 63 and 64. A cap 50 comprises an enlargement 51 and an outer threaded extension 52 projected from its front end and threadedly secured to the inner threads 32. A writing head 80 is fitted in a front end of the outer section 10 and comprises a channel 81 in fluid communication with the external and the bore 66 through the writing head 80. The provision of the channel 81 is for balancing internal and external pressures and thus smoothing a sliding operation of the pen sections.

Figure 4:
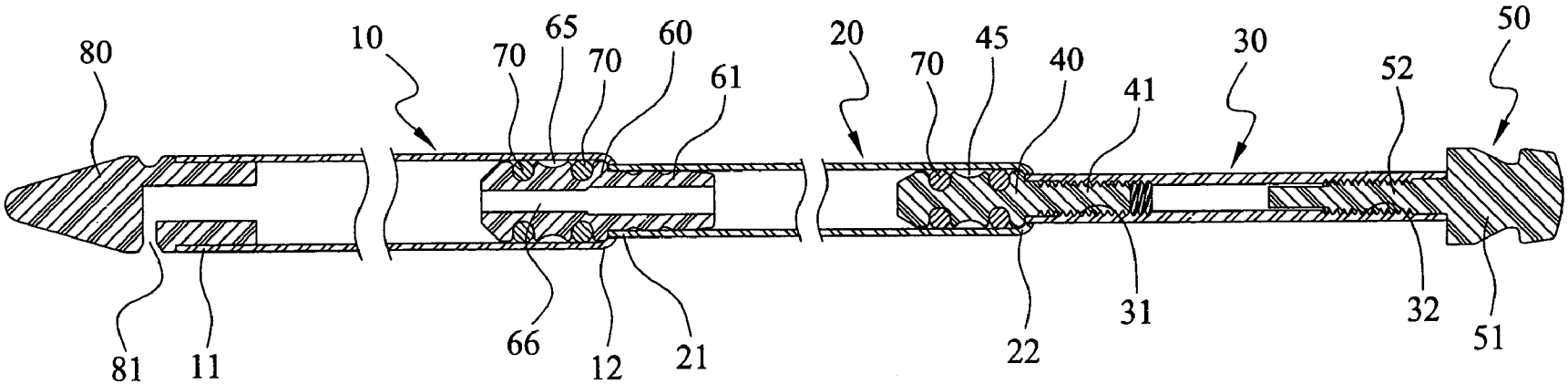
FIG. 4 is a view similar to FIG. 3 where the handwriting pen is fully extended.
Figure 5:
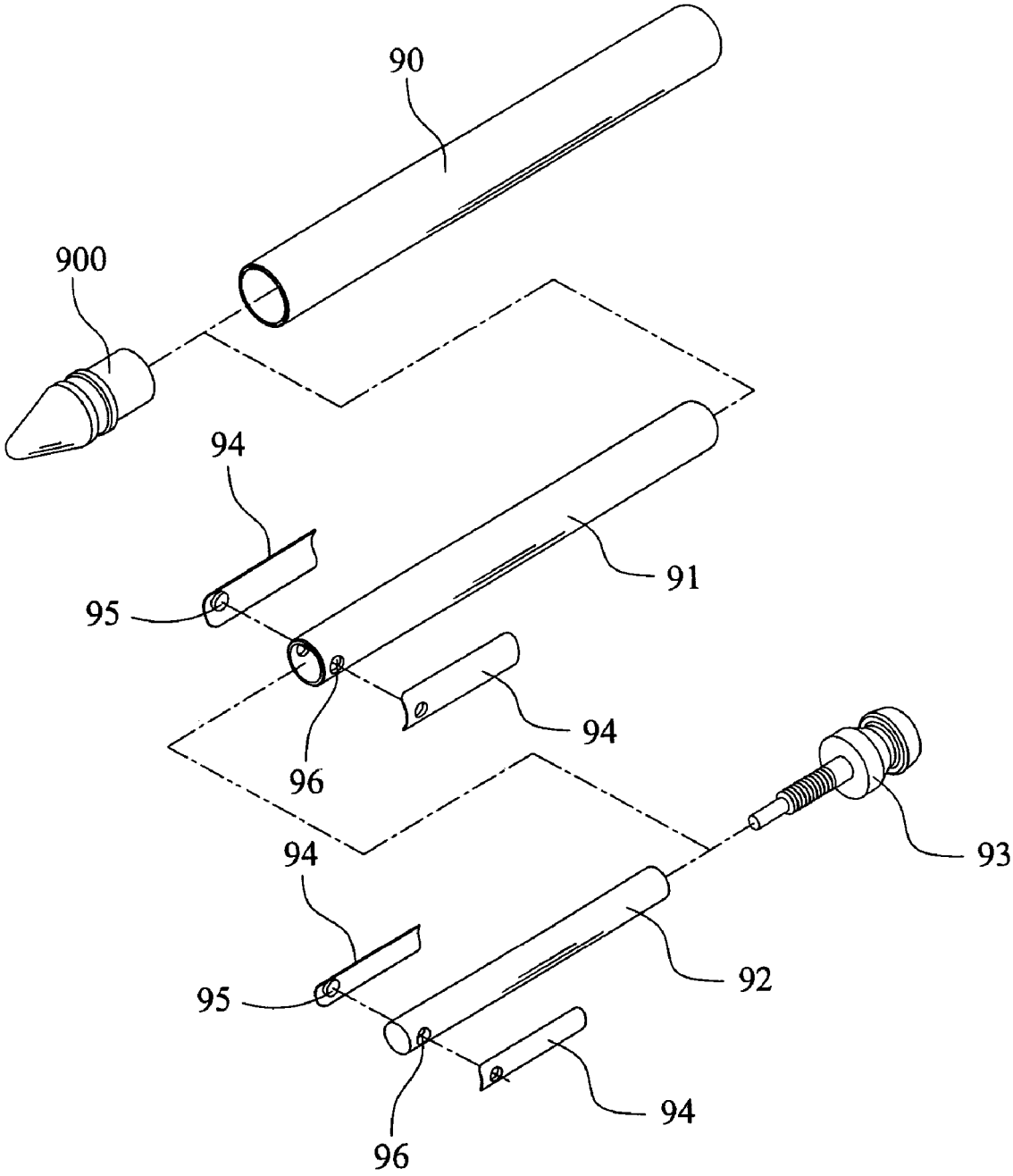
Fig. 5 PRIOR ART
FIG. 5 is an exploded view of a conventional telescopic handwriting pen.

Referring to FIG. 4, a user may slide the inner section 30 rearward by holding the enlargement 51 until a shoulder between the rear groove 44 and the threaded extension 41 is stopped by an inwardly extending rim 22 at a rear end of the intermediate section 20. At this position, the inner section 30 is fully extended. Next, further slide the inner section 30 rearward until a shoulder between the rear groove 64 and the outer extension 61 is stopped by an inwardly extending rim 12 at a rear end of the outer section 10. At this position, both the intermediate section 20 and the pen are fully extended.

Lubricating oil is filled in the recesses 45 and 65. Also, the O-rings 70 can prevent lubricating oil from leaking. Thus, a smooth sliding operation of the pen can be achieved and can last for a long period of time. Further, the O-rings 70 can balance the weight of the pen. In another embodiment, three sections are reduced to two sections. That is, the intermediate section is eliminated.

While the invention herein disclosed has been described by means of specific embodiments, numerous modifications and variations could be made thereto by those skilled in the art without departing from the scope and spirit of the invention set forth in the claims.

What is claimed is:

1. A telescopic handwriting pen comprising:

a tubelike inner section including at its both ends front and rear inner threads;

a first coupling assembly including a rod-shaped member having first and second annular grooves two first O-rings put on the first and the second grooves, an annular recess between the first and the second grooves filled with lubricating oil, and an outer threaded extension projected from its rear end threadedly secured to the front inner threads of the inner section;

a tubelike intermediate section including an inwardly extending rim at its rear end;

a hollow cylindrical second coupling assembly including a rod-shaped member having third and fourth annular grooves two second O-rings put on the third and the fourth grooves, an annular recess between the third and the fourth grooves filled with lubricating oil, and an outer extension projected from its rear and lockingly fitted in a front end of the intermediate section;

a cap including an outer threaded extension projected from its front end and threadedly secured to the rear inner threads of the inner section;

a tubelike outer section including an inwardly extending rim at its rear end; and a writing head lockingly fitted in a front end of the outer section, whereby sliding the inner section rearward by holding the cap until a shoulder between the rear groove of the first coupling assembly and the threaded extension of the first coupling assembly is stopped by the inwardly extending rim of the intermediate section, and further sliding the inner section rearward until a shoulder between the rear groove of the second coupling assembly and the outer extension of the second coupling assembly is stopped by the inwardly extending rim of the outer section will fully extend the handwriting pen.

2. The telescopic handwriting pen of claim 1, wherein the outer extension of the second coupling assembly is of toothed lengthwise section.

3. The telescopic handwriting pen of claim 1, wherein the cap is shaped as an enlargement.

4. The telescopic handwriting pen of claim 1, wherein the writing head comprises a channel in fluid communication with the external and inside of the second coupling assembly.

5. A telescopic handwriting pen comprising:

a tubelike inner section including at its both ends front and rear inner threads;

a first coupling assembly including a rod-shaped member having first and second annular grooves two first O-rings put on the first and the second grooves, an annular recess between the first and the second grooves filled with lubricating oil, and an outer threaded extension projected from its rear end threadedly secured to the front inner threads of the inner section;

a cap including an outer threaded extension projected from its front end and threadedly secured to the rear inner threads of the inner section;

a tubelike outer section including an inwardly extending rim at its rear end; and a writing head lockingly fitted in a front end of the outer section, whereby sliding the inner section rearward by holding the cap until a shoulder between the rear groove of the first coupling assembly and the threaded extension of the first coupling assembly is stopped by the inwardly extending rim will fully extend the handwriting pen.

6. The telescopic handwriting pen of claim 5, wherein the cap is shaped as an enlargement.

7. The telescopic handwriting pen of claim 5, wherein the writing head comprises a channel in fluid communication with the external and inside of the first coupling assembly.

* * * * *